US006056862A

United States Patent [19]

Kumagai

[11] Patent Number: 6,056,862

[45] Date of Patent: May 2, 2000

[54] PROCESS AND APPARATUS FOR SUPPLYING METAL IONS TO ALLOY ELECTROPLATING BATH

[75] Inventor: Naokazu Kumagai, Matsudo, Japan

[73] Assignee: Daiki Engineering Co., Ltd., Tokyo, Japan

[21] Appl. No.: 09/181,932

[22] Filed: Oct. 28, 1998

[30] Foreign Application Priority Data

Oct. 30, 1997 [JP] Japan ..... 9-298481

[51] Int. Cl.[7] ..... C25D 21/18

[52] U.S. Cl. ..... 205/101; 204/237; 204/DIG. 13

[58] Field of Search ..... 205/99, 101; 204/232, 204/237, 238, 239, DIG. 13

[56] References Cited

U.S. PATENT DOCUMENTS 2,541,721 2/1951 Roehl et al. ..... 205/101

3,474,011 10/1969 Guertin et al. ..... 205/101

*Primary Examiner*—Kathryn Gorgos
*Assistant Examiner*—William T. Leader
*Attorney, Agent, or Firm*—Kubovcik & Kubovcik

[57] ABSTRACT

Disclosed is a process for supplying nickel ions for a nickel alloy electroplating bath so as to replenish nickel ions consumed as electroplating progresses. The process uses an electrolysis cell, which is equipped with a rotatable cathode in the form of a drum or a disk having a surface of titanium or hard chromium plating; and an anode made of a titanium basket in which sulfur-containing metallic nickel is contained. Spent electroplating solution is electrolyzed in the electrolysis cell to dissolve nickel in the anode basket into the solution as ions and deposit a part of the dissolved nickel on the cathode, which is removed therefrom as the cathode rotates, while the rest of the dissolved nickel remains in the solution. The solution thus replenished with nickel ions is reused for the electroplating. The process may also be used to provide cobalt ions to replenish a spent cobalt alloy electroplating solution.

9 Claims, 3 Drawing Sheets

PROCESS AND APPARATUS FOR SUPPLYING METAL IONS TO ALLOY ELECTROPLATING BATH

BACKGROUND OF THE INVENTION

The present invention concerns an improved process for supplying metal ions to a bath for electroplating a nickel alloy or cobalt alloy for the purpose of replenishing nickel or cobalt ions consumed in the electroplating step. The invention concerns also an apparatus for carrying out the process.

Nickel alloy electroplating or electroplating of a combination of nickel and a base metal, such as zinc-nickel or tin-nickel, has been widely practiced to obtain high corrosion resistance. Also practiced is cobalt alloy electroplating or electroplating of a combination of cobalt and a base metal, such as zinc-cobalt. Since the nickel alloy electroplating and cobalt alloy electroplating are quite similar technologies, the following explanation is given on the nickel alloy electroplating.

As the result of progress of electroplating ions of nickel and the mating metal in the electroplating solution will inevitably be consumed and the cations or metal ions are replaced with hydrogen ions, and the pH of the electroplating solution will decrease. When replenishing metal ions to the electroplating bath, base metals such as zinc and tin may be ionized by chemical reactions when metal pellets are charged into the solution. On the other hand, nickel, a corrosion-resistant metal, may not be ionized by simply charging the metal pellets into the solution having the decreased pH, and therefore, replenishment of nickel ions must be realized by some other methods. The conventional method of replenishing nickel ions to a nickel alloy electroplating solution is carried out by dissolving nickel carbonate.

Nickel carbonate is relatively expensive, and it is difficult to obtain a product of high purity. Commercially available products are called "basic nickel carbonate" and contain, in addition to nickel carbonate, not only nickel hydroxide but also sodium carbonate. Use of low purity nickel carbonate may result in low quality in electroplated products by unbalancing of pH or by invasion of undissolved nickel hydroxide (solubility of which is low) into the electroplating line.

As one of the breakthroughs of this problem, it was proposed to ionize metallic nickel by electrolysis and replenish the nickel ions to the electroplating bath (see for example, Japanese Patent Disclosures No. 4-13900 and No. 6-25900).

In these methods electrolysis is carried out by using an anode of metallic nickel and a cathode of a material having a low hydrogen overpotential such as a noble metal of the platinum group, and hydrogen gas evolves from the cathode. In other words, deposition of nickel on the cathode, which is a principal reaction, is prevented by giving priority to hydrogen gas generation reaction at the cathode so as to have the nickel ions retained in the solution.

Even though a substance which has a low hydrogen over-potential and is active to generation of hydrogen gas is used as the material of cathode, it is practically impossible to completely suppress deposition of a metal such as nickel over a long period of time. Therefore, it is tried to redissolve the deposited nickel by application of electric current in the reverse polarity so as to heighten the recovery percentage of nickel. However, repeated reverse application of electric current causes dissolving out of the cathode surface layer having high catalytic activity for the hydrogen generation reaction, and initial performance of the electrode is lost. Thus, life of the electrode is not as long as acceptable in practical use.

SUMMARY OF THE INVENTION

The object of the present invention is to solve the above described problems encountered in supplying metal ions to the solution for electroplating a nickel alloy or a cobalt alloy and to provide an improved process and apparatus for supplying metal ions to the alloy electroplating bath, in which it is not necessary to use an expensive material for the electrode such as platinum, and no care to loss of the electrode is necessary for a long period of time, and therefore, is economical from the view points of both the investment and running costs.

DETAILED DESCRIPTION OF THE PREFERRED EMBODIMENTS

The process of the present invention achieving the above object is a process for supplying metal ions to a nickel alloy or cobalt alloy electroplating bath, which comprises;

- using metallic nickel or cobalt containing sulfur as the anode material;
- transferring spent electroplating solution from a circulation tank to an electrolysis cell which is equipped with a rotatable cathode made of a metal drum or a metal disk;
- electrolyzing the spent electroplating solution in the electrolysis cell to dissolve nickel or cobalt in the anode to form nickel ions or cobalt ions in the solution;
- depositing the nickel alloy or the cobalt alloy on the cathode;
- rotating the cathode to continuously remove the deposited nickel or cobalt alloy from the cathode surface; and
- returning the electroplating solution replenished with nickel ions or cobalt ions to the circulating tank.

The process of the present invention for supplying metal ions consumed in the alloy electroplating step can be applied to any electroplating using a combination of nickel and a base metal, such as zinc-nickel and tin-nickel, or cobalt and a base metal such as zinc-nickel. The following explanation is given in regard to nickel-zinc electroplating as a typical embodiment.

Figure 1:
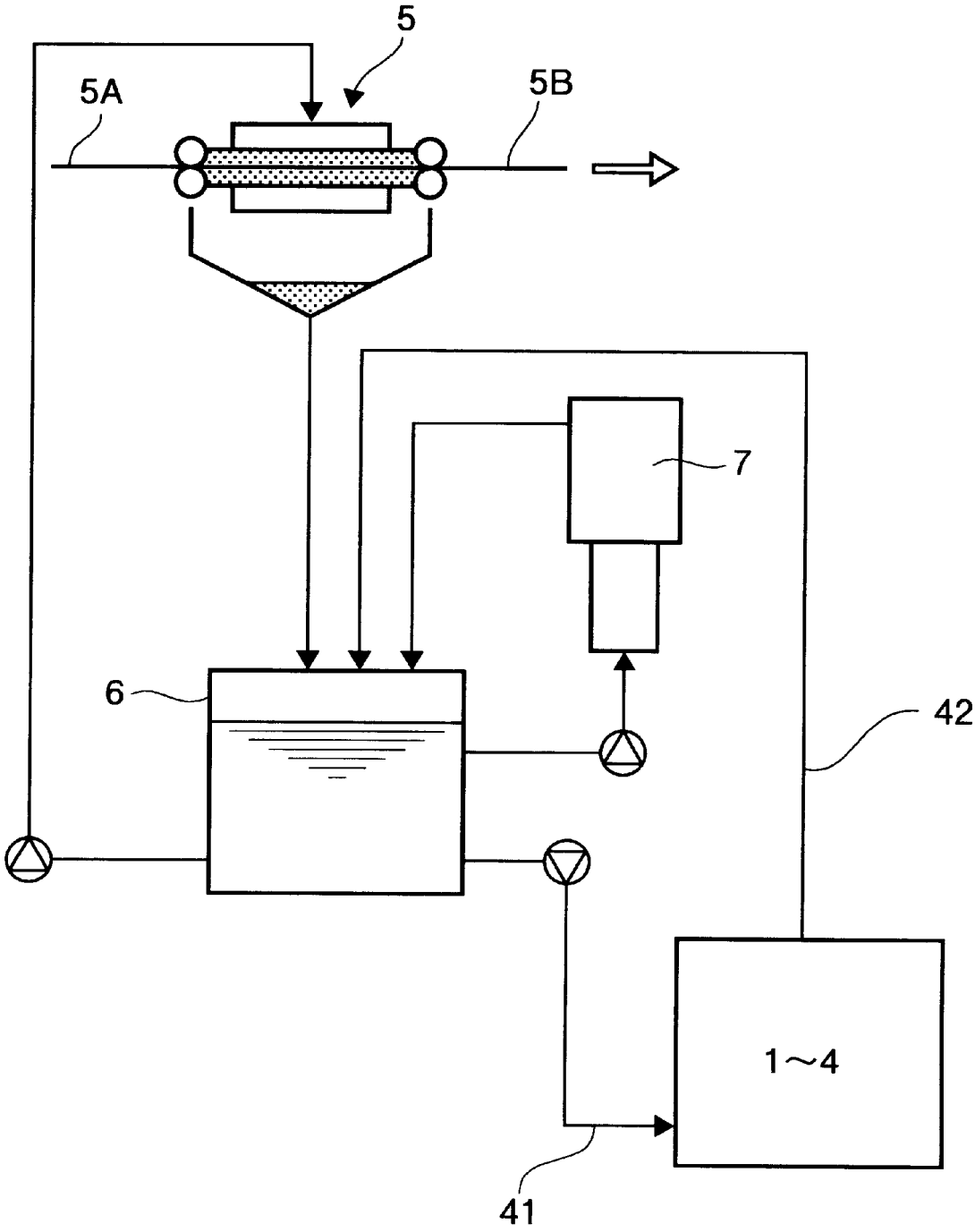
FIG. 1 is a flow chart showing elements of a plant for nickel alloy electroplating using the apparatus for supplying nickel ions according to the present invention.
Figure 2:
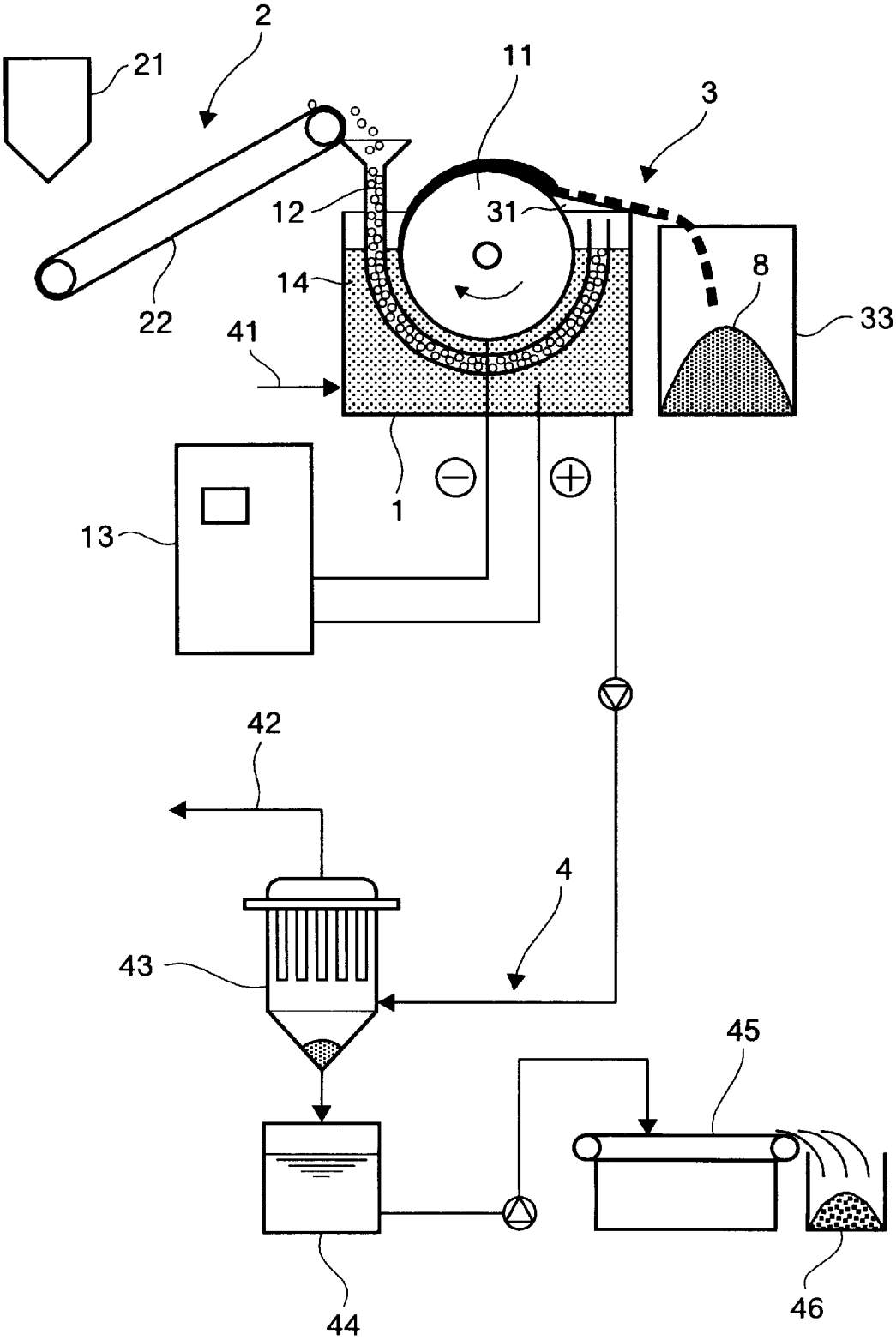
FIG. 2 illustrates the details of the electrolysis cell of the apparatus for supplying nickel ions according to the present invention shown in FIG. 1.

The apparatus of the invention for carrying out the above process is an apparatus for supplying nickel ions to a nickel alloy electroplating bath, as shown in FIG. 1 with the rest of the elements of the plant and in FIG. 2 in detail, comprising:

- an electrolysis cell 1 equipped with a cathode 11 which is made of a rotatable metal drum or metal disk, an anode 12 made of perforated plates in the form to partially surround the above cathode and to contain sulfur-containing metallic nickel for dissolving out nickel therefrom, and means for supplying nickel 2 to supply the sulfur-containing metallic nickel;

means for removing metal 3 to continuously remove nickel alloy deposited on the cathode by the electrolysis in the electrolysis cell; and means for circulating nickel ion-containing solution 4 to receive spent electroplating solution from a circulation tank for nickel alloy electroplating solution and to send back electroplating solution replenished with nickel ions.

It is preferable to construct at least the surface layer of the rotatable metal drum or metal disk, which takes the role of cathode, with titanium or titanium alloy, lead or lead alloy, aluminum or aluminum alloy, or a stainless steel. Also, it is preferable to coat the surface of the cathode with a layer of hard chromium plating. These materials on the cathode surface make it easy to peel the deposited nickel alloy. Even though any material can be used as the surface layer of the cathode, it is essential to finish the surface as smooth as possible. This is because little nickel deposits on the smooth surface of cathode and therefore, the cathode can be used over a long period of time.

The best material for the cathode is titanium. Titanium is, however, soft and scars may easily occur on the surface of a titanium cathode. Also, titanium is tenacious, and therefore, mirror finishing is difficult to achieve. To overcome these problems it is advantageous to use a suitable titanium alloy or to treat the surface of the cathode by an appropriate surface treatment technology such as quenching or nitriding. A more positive countermeasure is to install a polishing device at the back of a doctor blade or a scraper, which will be explained below, to polish the cathode surface so that a fresh, smooth surface can be maintained.

As the cathode a drum-shaped cathode is the most simple and convenient. However, a disk-shaped cathode may also be used and the nickel alloy can be deposited on both sides of the disk. In the case where a disk-shaped cathode is used, the anode should be disposed to face both sides of the disk. The disk-shaped cathode may consist of two or more disks compiled in one axis with certain intervals so that the cathode may have a large surface area. There may be variations of the cathode further to the above mentioned drum and disk, such as an intermediate shape of the drum and disk or two cones compiled back to back in one axis. In general, a disk-shaped cathode may have a larger electrode area than that of a drum-shaped cathode at the same installation space in the plant.

As seen in FIG. 1 and FIG. 2, means for circulating nickel ion-containing solution 4 comprises electroplating solution receiving line 41 for receiving the solution from electroplating solution circulation tank and electrolyte sending line 42 for sending back the electrolyte solution replenished with nickel ions to the circulation tank 6. In FIG. 2, reference 13 is for the power source supplying direct current to the electrolysis cell. Means for supplying metallic nickel 2 comprises a hopper 21 for storage of metallic nickel of a suitable particle size and a conveyer 22 for conveying the nickel pellets from the hopper. The nickel pellets supplied to the electrolysis cell 1 contact the anode 12 made of two perforated plates, and nickel dissolves out from the pellets as ions into the solution. Decreased quantity of the pellets as the progress of dissolution is supplemented when necessity occurs. In the system cathode-anode distance is kept constant, and thus, electrochemical reactions at both the electrodes proceed steadily and the material balance in the electrolysis solution is maintained.

The nickel pellets used should contain a certain amount of sulfur, preferably, 0.003–0.5% by weight. The sulfur component prevents passivation of nickel at the anode and facilitates dissolution of nickel as ions. Sulfuric acid concentration in the spent electroplating solution or the solution from which nickel was deprived is in the range of 10–40 g/l, and therefore, without the sulfur component nickel may not dissolve efficiently due to possible passivation on the anode.

Conditions for the electrolysis in the electrolysis cell may be chosen in a wide range. Preferable cathode current density is 1–70 A/dm$^2$. Needless to say, at a lower current density the electrolysis to dissolve out the necessary quantity of nickel ions takes too long a period of time. On the other hand, electrolysis under a too high current density exceeding 70 A/dm$^2$ causes sub-reactions to generate oxygen gas, and thus current efficiency will decrease. In general, a current density around 20 A/dm$^2$ is advantageous to practice because a high dissolution efficiency of nickel and stability in operation is assured.

The resulting electrolyte solution or the electroplating solution containing replenished nickel ions is, after being filtered by a nickel ion-containing solution filter 43 to remove possible solid substances suspended in the solution, returned to circulation tank 6. The solid substances separated by this filter are transferred to a drain tank 44 by occasional back washing. The resulting drain is subjected to solid-liquid separation by a sludge filter 45, and the sludge is stored in a sludge tank 46. The remaining liquid may be returned to electroplating cell 1 for reuse or treated to be harmless and disposed.

The nickel alloy, typically zinc-nickel alloy, deposited on cathode 11 is peeled therefrom by a doctor blade 31 contacting the rotating cathode, and is removed little by little out of the electroplating cell. Peeling of the deposited alloy may become easier as the layer grows thicker. When the thickness reaches around 100 $\mu$m the deposited alloy layer rises from the cathode surface due to stress occurring in the layer itself, and is easily separated. The deposited alloy and the electrolyte solution react to evolve hydrogen gas. Above the line from which the alloy on the cathode drum comes out of the electrolyte solution, evolution of hydrogen gas is observed to push up the deposited metal layer and promotes peeling. Alloy flakes adhered on the doctor blade may be washed off by spraying the electrolyte solution. Reference 33 indicates a container for the alloy deposited on the cathode and separated therefrom.

In the case where a disk-shaped cathode is used, scrapers 32 with spouts are used as the doctor blades for the cathode surfaces to scrape the deposited alloy, and the scraped alloy is washed away from the electrolysis cell by pouring the electrolyte solution. Practically, direct spraying the electrolyte solution to the disk surfaces is sufficient to crush the deposited alloy which is rising from the cathode, and the crushed alloy will fall in the spouts.

The reason why the deposited metal is transferred to outside of the electrolysis cell is that the deposited metal, if it stays in the electrolysis cell, reacts with the electrolyte solution to generate hydrogen gas. Pieces of the deposited metal to which hydrogen gas bubbles have adhered will float on the surface of the electrolyte solution and, if they accumulate, cause short circuits between the cathode and the anode. It is, therefore, preferable to bring all the deposited metal out of the electrolysis cell. A small amount may, however, not cause a serious problem. If a certain amount of the deposited metal is inevitably falls in the electrolysis cell, it is advisable to cause a stream at the surface of the electrolyte solution so that the floating pieces of the deposited metal may be forced out of the cell.

In the case where a doctor blade 31 or a scraper 32 is used choice of the material and accuracy of installation are essential. The material used should have a hardness lower than that of the cathode material. Suitable material may be found in the group of synthetic resins such as high density polyethylene, polypropylene, polyvinyl chloride and PTFE, and the group of elastomers such as fluorine-rubber, EPDM, hyperon, silicone rubber and butyl rubber. If a suitable material is not used or accuracy of installation is low, many scars will be formed on the cathode surface during operation. The scars may cause adhesion of the deposited metal onto the cathode surface and result in difficulty in peeling.

It is advisable to use a jet of a fluid onto the cathode surface instead of the doctor blade and the scraper to wash away the deposited metal, because this will not give damage on the cathode. The electrolyte solution may be used as the fluid.

Because the nickel alloy thus collected may dissolve in the electroplating solution, the alloy is smashed and charged into the circulation tank 6 to utilize as the sources of zinc ions and nickel ions. The deposited zinc-nickel alloy is brittle and can be smashed into powder by low power.

EXAMPLE 1

The present process for supplying nickel ions was applied to a nickel alloy electroplating line in which a steel sheet of width 1820 mm is transferred at a line speed of 90 m/min. and zinc-nickel alloy (weight ratio Zn:Ni=88:12) is continuously plated thereon. The plant has an electroplating solution circulation tank of capacity 50 $m^3$, through which the solution circulates at a rate of 144 $m^3$/hour. The nickel ion supplying apparatus comprises the parts as shown in FIG. 2. The cathode is a drum coated with titanium. The anode is a titanium basket disposed under the drum in a curved form, to which sulfur-containing nickel pellets are supplied.

The amount of electroplated alloy is 30 g/$m^2$ on each side of the steel sheet, and therefore, the metal plated from of the electroplating solution is 589.7 kg/hour. Of the metal zinc (88%) shares 518.9 kg, and nickel (12%), 70.7 kg. Because replenishment of zinc ions is carried out in zinc pellet dissolving tank 7 in FIG. 1, it is only necessary to replenish the spent electroplating solution with nickel ions in the present apparatus at a rate of 70.7 kg/hour. Since the ion concentrations in the electroplating solution are: zinc 45 kg/$m^3$ and nickel 86 kg/$m^3$, respectively, the solution of 50 $m^3$ contains 50 times of the ions of these quantity of ions.

The spent electroplating solution received from the solution circulation tank was fed to the electrolysis cell through the bottom inlet and subjected to electrolysis with constant cathode current density of 40 A/$dm^2$. Flow rate of the solution at the cathode surface was 40 g/min. and temperature of the electrolyte solution was 65° C. Cathode current efficiency was 95%.

Zinc-nickel alloy deposited on the cathode was scraped off by a doctor blade as shown in FIG. 2 to remove it from the electrolysis cell. The deposited metal, after being rinsed and dried, weighed 84.42 kg/hour. According to analysis the alloy consisted of zinc 88% and nickel 12%, the same as in the electroplated alloy. The quantities of the metal deposited on the cathode were zinc 74.29 kg/hour and nickel 10.13 kg/hour.

On the other hand, the quantity of the metallic nickel dissolved at the anode was 80.89 kg/hour. Anode current efficiency was, therefore, almost 100%. Nickel supplied to the electroplating solution in the form of ions was calculated by:

Dissolved Quantity—Deposited Quantity =80.89 kg/hour−10.13 kg/hour 70.76 kg/hour and it is found that the nickel consumed in the electroplating line, 70.7 kg/hour was thus replenished. With respect to zinc, 74.29 kg/hour was lost by removal of the alloy deposited on the cathode as noted above, and sum of this amount and 518.9 kg/hour consumed in the electroplating line, 593.2 kg/hour, was replenished by dissolving zinc pellets in the zinc dissolving tank.

EXAMPLE 2

Figure 3A:
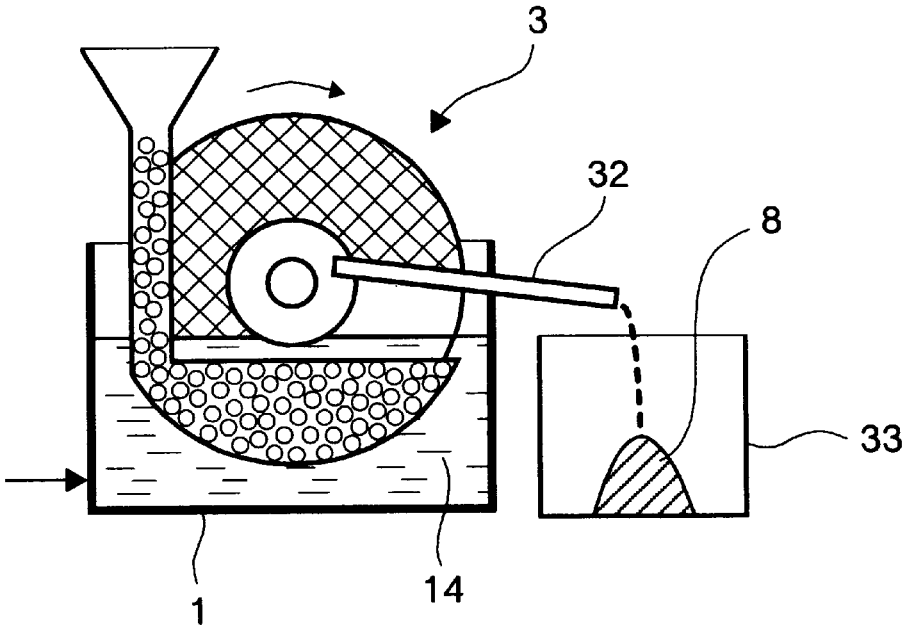
FIG. 3 illustrates another embodiment of the electrolysis cell of the apparatus for supplying nickel ions shown in FIG. 2.
Figure 3B:
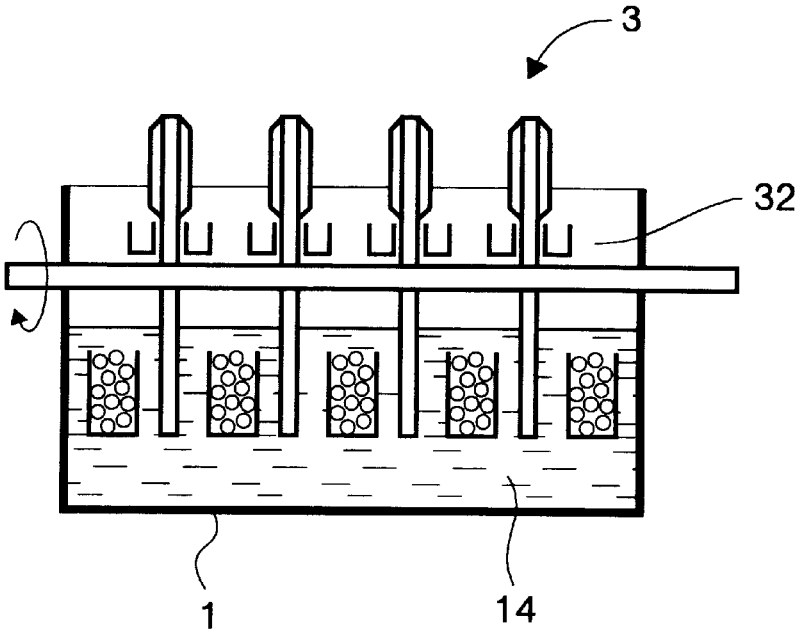

The drum-shaped cathode used in Example 1 was replaced with a disk-shaped cathode as shown in FIG. 3 and the above described nickel ion supply was repeated. The disk-shaped cathode consists of four disks of radius 600 mm in one axis, and both sides of the disks are active as the cathode surface. The disks were so installed that 444 mm from the edges was in the electrolysis solution and rotated during the electrolysis which was carried out under a current density of about 20 A/$cm^2$. Temperature of the electrolyte solution was 65° C., the same as that in Example 1. The cathode current efficiency was substantially the same as that in Example 1.

I claim:

1. A process for supplying metal ions to a bath for electroplating a nickel alloy or a cobalt alloy, which comprises;

transferring spent electroplating solution from a circulation tank to an electrolysis cell which is equipped with a rotatable cathode comprising a metal drum or a metal disk and an anode comprising sulfur-containing metallic nickel or cobalt;

electrolyzing the spent electroplating solution in the electrolysis cell to dissolve nickel or cobalt from the anode to form nickel ions or cobalt ions thereby replenishing the solution, and to deposit nickel alloy or cobalt alloy on the cathode;

rotating the cathode and continuously removing the deposited nickel alloy or cobalt alloy from the cathode surface; and returning the electroplating solution replenished with nickel ions or cobalt ions to the circulation tank.

2. A process according to claim 1, wherein the spent electroplating solution is a zinc-nickel electroplating solution.

3. A process according to claim 2, wherein a nickel alloy is deposited on the cathode surface and subsequently removed from the cathode surface, and the nickel alloy removed from the cathode surface is dissolved in the electroplating solution in the circulation tank and reused.

4. A process according to claim 1, wherein a nickel alloy is deposited on the cathode surface and subsequently removed from the cathode surface, and the nickel alloy removed from the cathode surface is dissolved in the electroplating solution in the circulation tank and reused.

5. A process according to claim 1, wherein the spent electroplating solution is a zinc-cobalt electroplating solution.

6. A process according to claim 5, wherein a cobalt alloy is deposited on the cathode surface and subsequently removed from the cathode surface, and the cobalt alloy removed from the cathode surface is dissolved in the electroplating solution in the circulation tank and reused.

7. A process according to claim 1, wherein a cobalt alloy is deposited on the cathode surface and subsequently removed from the cathode surface, and the cobalt alloy removed from the cathode surface is dissolved in the electroplating solution in the circulation tank and reused.

8. An apparatus for supplying metal ions to a bath for electroplating a nickel alloy or a cobalt alloy, comprising:

a circulation tank for containing spent electroplating solution comprising nickel ions or cobalt ions:

an electrolysis cell equipped with a cathode which comprises a rotatable metal drum or metal disk to receive a deposit of nickel or cobalt alloy thereon, an anode comprising perforated plates in a configuration which partially surrounds said cathode and which contains sulfur-containing metallic nickel or cobalt for dissolving out nickel or cobalt therefrom to replenish nickel ions or cobalt ions in the spent electroplating solution;

means for supplying said sulfur-containing metallic nickel or cobalt to said anode;

means for continuously removing nickel alloy or cobalt alloy deposited on the cathode by electrolysis in the electrolysis cell; and means for circulating the nickel ion- or cobalt ion-containing spent electroplating solution from said circulation tank to said electrolysis cell and to send back electroplating solution replenished with nickel ions or cobalt ions from said electrolysis cell to said circulation tank.

9. An apparatus for supplying metal ions to a bath for electroplating a nickel alloy or a cobalt alloy according to claim 8, wherein the metal drum or the metal disk comprises a surface layer which is made of titanium or titanium alloy, lead or lead alloy, aluminum or aluminum alloy, a stainless steel or hard chromium plating.

* * * * *